United States Patent [19]

Hasegawa et al.

[11] Patent Number: 5,022,642

[45] Date of Patent: Jun. 11, 1991

[54] SHEET FEEDING DEVICE FOR A IMAGE DEVELOPING AND PROCESSING MACHINE

[75] Inventors: Takanori Hasegawa; Hideo Negishi, both of Tokyo, Japan

[73] Assignee: Riso Kagaku Corporation, Japan

[21] Appl. No.: 385,362

[22] Filed: Jul. 27, 1989

[30] Foreign Application Priority Data

Jul. 29, 1988 [JP] Japan ..... 63-191225

[51] Int. Cl.[5] ..... B65H 3/06

[52] U.S. Cl. ..... 271/10; 271/110; 271/121; 271/227; 271/242

[58] Field of Search ..... 271/110, 111, 121, 227, 271/242, 10

[56] References Cited

U.S. PATENT DOCUMENTS 4,025,187 5/1977 Taylor et al. .

FOREIGN PATENT DOCUMENTS 2205049 5/1974 France .
156142 12/1980 Japan ..... 271/110
156143 12/1980 Japan ..... 271/110
2190363 11/1987 United Kingdom .

*Primary Examiner*—Richard A. Schacher
*Attorney, Agent, or Firm*—Stevens, Davis, Miller & Mosher

[57] ABSTRACT

A sheet feeding device is provided for taking up and feeding a plurality of sheets one by one by a selectively driven sheet feeding roller from the stack thereof positioned on a sheet feeding base to a register roller and for transporting the sheet to an image developing and processing device at a predetermined timing by the register roller; the feeding device comprising a movable sheet guide member provided between the feeding roller and the register roller which is adapted to be displaced by the curving deformation of a sheet between the feeding roller and the register roller in the direction of the growing of the curving deformation. The feeding device may further comprise a detector for sensing the displacement of the sheet guide member to determine based upon the displacement that a predetermined curvature of a sheet has been reached, and a control for stopping the rotation of the feeding roller in response to the detection by the detector so as to prevent the sheet from deforming excessively.

2 Claims, 7 Drawing Sheets

SHEET FEEDING DEVICE FOR A IMAGE DEVELOPING AND PROCESSING MACHINE

BACKGROUND OF THE INVENTION

1. Field of the invention

The present invention relates to a sheet feeding device incorporated in an image developing and processing machine such as a copy machine, a printing press or the like, and more particularly, relates to such a sheet feeding device for feeding sheets one by one to an image developing and processing section in the machine.

2. Prior art

The sheet feeding device incorporated in an image developing and processing device such as a copy machine, a printing press or the like is in general adapted to take up and feed a plurality of sheets one by one by means of a selectively driven sheet feeding roller from the stack thereof positioned on a sheet feeding base to a pair of register rollers or timing rollers and then to transport the sheet by the register rollers to an image developing and processing means such as a form cylinder or a copying photosensitive element drum at a timing that is in timed relation to the operation of the image developing and processing means. This type of sheet feeding devices are well known in the art and are shown and described for example in the Japanese Patent Publication No. 58-7582, the Japanese Patent Laying Open Publication No. 62-157145 and the like.

In such sheet feeding devices as mentioned above, each sheet fed by the sheet feeding roller from the sheet feeding base toward the image developing and processing means once stops with its leading edge contacting with the register rollers at the contact parts therebetween, and is transported at a predetermined timing to the image developing and processing means by the register rollers which are started to rotate at a predetermined timing. Since the sheet feeding roller continues to rotate at least for a little while even after a sheet has arrived at and contacted with the register rollers at the leading edge thereof, the sheet generates in itself a ridge-like curvature growing across the moving direction thereof between the sheet feeding roller and the register rollers before the latter rollers begin to transport the sheet towards the image developing and processing means.

In order to permit such a sheet deformation as mentioned above, therefore, a sheet guide passage defined between the sheet feeding roller and the register rollers must have a relatively large space extended in the direction of the curvature growth and, accordingly, an upper guide plate which defines the upper boundary of the sheet guide passage is in general bent upward at the front part thereof to extend the upper space of the passage.

With the sheet guide passage being constructed as above, if the leading end of the sheet being fed through the passage has been curled up, it comes into collision against the upwardly bent portion of the upper guide plate and is prevented from moving further, resulting in an abnormal sheet feeding and causing a sheet jamming. Especially, if such a situation occurred when a relatively tough sheet such as a cardboard or the like being used, it could not be fed further because of the jamming.

On the other hand, if the inclination of the upwardly bent portion of the upper guide plate was reduced and the extended upper space in the sheet guide passage was reduced, the drawback mentioned Just above might be eliminated. In that event, however, sheet would be impeded from generating a necessary arcuate deformation, resulting in improper sheet feeding.

SUMMARY OF THE INVENTION

The principal object of the present invention is to provide an improved sheet feeding device which solves all the above mentioned drawbacks and can surely perform a normal and positive sheet feeding.

An another obJect of the present invention is to provide such a sheet feeding device which is adapted to prevent sheet from generating too much curvature, thereby avoiding the occurrence of sheet feeding fault due to the excess curvature of sheet. The above primary object is accomplished according to the present invention, by a sheet feeding device for an image developing and processing machine comprising a sheet feeding base on which a plurality of sheets are stacked, a selectively driven sheet feeding roller for taking up and feeding a plurality of sheets one by one from said stack, and a register roller means for transporting the sheet to an image developing and processing device at a predetermined timing, characterized in further comprising a movable sheet guide member provided between said sheet feeding roller and said register roller means which is adapted to be displaced by the curving deformation of a sheet between said sheet feeding roller and said register roller means in the direction of the growing of said curving deformation. The above additional object is accomplished, according to the present invention, by a sheet feeding device for an image developing and processing machine comprising a sheet feeding base on which a plurality of sheets are stacked, a selectively driven sheet feeding roller for taking up and feeding a plurality of sheets one by one from said stack, and a register roller means for transporting the sheet to an image developing and processing device at a predetermined timing, characterized in further comprising a movable sheet guide member provided between said sheet feeding roller and said register roller means which is adapted to be displaced by the curving deformation of a sheet between said sheet feeding roller and said register roller means in the direction of the growing of said curving deformation, a detecting means for sensing the displacement of said sheet guide member to determine based upon the displacement that a predetermined curvature of the sheet has been reached, and a stopper means for stopping the rotation of said sheet feeding roller in response to the detection by said detecting means.

According to the above mentioned former construction, the displacing of the sheet guide member effected according to the growth of the curvature in the sheet being fed extends the space in the sheet guide passage according to the growth of the curvature in the sheet which allows the sheet to deform arcuately. In the initial stage of the sheet feeding process the sheet guide passage does not define an excessive space, so that the situation is prevented from occurring wherein sheet collides at the leading edge thereof against the surface of the guide plate which would otherwise define an extended space and is accordingly impeded from moving further, and in the later stage the guide plate allows the sheet to deform arcuately, thereby preserving a positive sheet feeding.

According to the latter construction mentioned above, the extent of arcuate deformation of the sheet formed between the sheet feeding roller and the register roller means can positively be detected based upon the displacement of the movable sheet guide member, and the rotation of the sheet feeding roller is stopped when a predetermined extent of the curvature has been reached, to prevent the sheet from deforming more above the predetermined extent and to prevent sheet feeding fault from occurring due to an excessive curvature of the sheet.

The present invention is now described in terms of embodiments with reference to the accompanied drawings.

BRIEF DESCRIPTION OF THE DRAWINGS

In the accompanying drawings.

DESCRIPTION OF THE PREFERRED EMBODIMENTS

Figure 1:
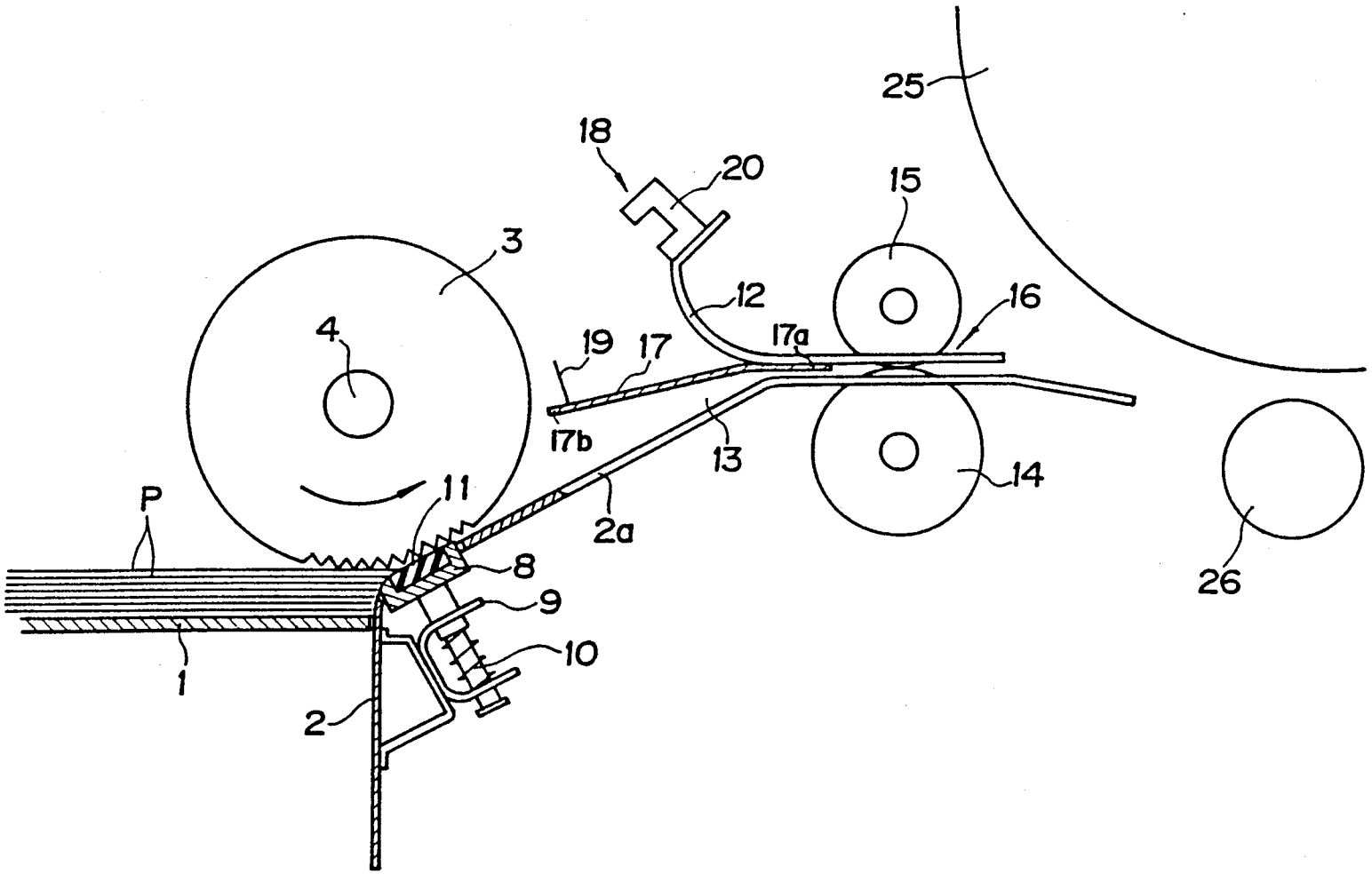
FIG. 1 is a schematic side view showing in vertical section a first embodiment of the sheet feeding device of the present invention.
Figure 2:
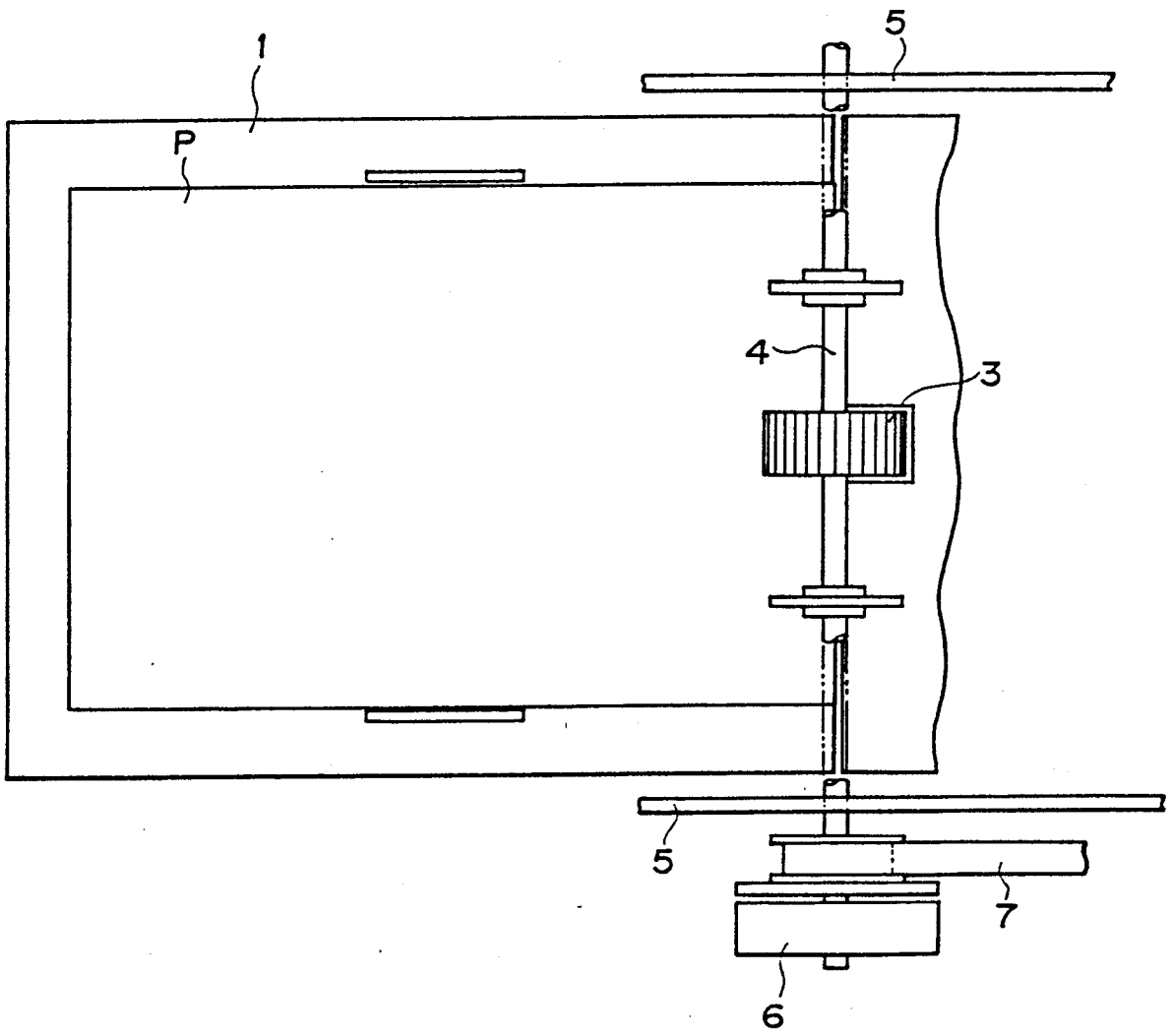
FIG. 2 is a schematic plan view showing the first embodiment of the sheet feeding device shown in FIG. 1.

FIGS. 1 through 4 show the first embodiment of the sheet feeding device of the present invention. Referring to these figures, 1 denotes a sheet feeding base, on which a plurality of sheets P are stacked and which is adapted to be moved up and down in a suitable manner well known in the art by an actuator not shown in the figures that is controlled by an electric controller also not shown in the figures. A vertical wall plate 2 is fixedly provided at the end of the sheet feeding base 1 which is the right end as viewed in the figures, i.e. the downstream end as viewed along the sheet feeding direction, and serves to position the leading edges of the sheets P stacked on the base 1. As shown in FIG. 1, the upper end of the wall plate is slightly bent in the downstream direction.

Above the wall plate 2 is provided a sheet feeding roller 3 made of rubber or other similar suitable material having a relatively high coefficient of friction. The sheet feeding roller 3 is rotatably supported by way of a support shaft 4 from side plates 5 positioned on both sides of the roller. The support shaft 4 is drivingly connected with a transmission belt 7 by way of an electromagnetic clutch 6 and is rotationally driven in the anti-clockwise direction as viewed in FIG. 1 only during the clutch 6 is in its engaged state. Thus the sheet feeding roller 3 is rotationally driven in the anti-clockwise direction as viewed in FIG. 1 during the period when the electromagnetic clutch 6 is active. The operation of the clutch is also controlled by the electric controller.

Near the upper end of the wall plate 2 is provided a sheet separating pad holder 8, the upper surface of which opposes to the cylindrical outer surface of the sheet feeding roller 3. The pad holder 8 is supported by a bracket 9 secured to the wall plate 2 so that it may move relative to the bracket substantially in the direction along the radius of the sheet feeding roller 3, and is biased by the force exerted by a compression coil spring 10 against the cylindrical outer surface of the roller 3. A sheet separating pad 11 is fixedly attached to the upper surface of the pad holder 8. The pad is made of a material having a relatively high coefficient of friction such as rubber, its affinities, or cork, and its upper surface opposes to and substantially abuts with the outer cylindrical surface of the sheet feeding roller 3.

A sheet feeding passage or sheet guide passage 13 is defined by both fixed lower and upper guide plates 2*a*, 12 and a movable sheet guide plate 17 downstream of the sheet feeding roller 3 and upstream of the image developing and processing section consisting of a form cylinder 25 and a press roller 26 corresponding thereto. The sheet feeding passage 13 extends from the sheet feeding roller 3 toward the image developing and processing section and at the location near the downstream end of the passage is positioned a register roller means 16 consisting of a pair of upper and lower roller elements 14 and 15, respectively. The roller elements rotatably contact with each other at their cylindrical outer surface. The roller element 14 is a driving roller selectively rotated in the clockwise direction as viewed in FIG. 1 by an actuator not shown in the figures and the roller element 15 is a driven roller rotated by the element 14.

Figure 3:
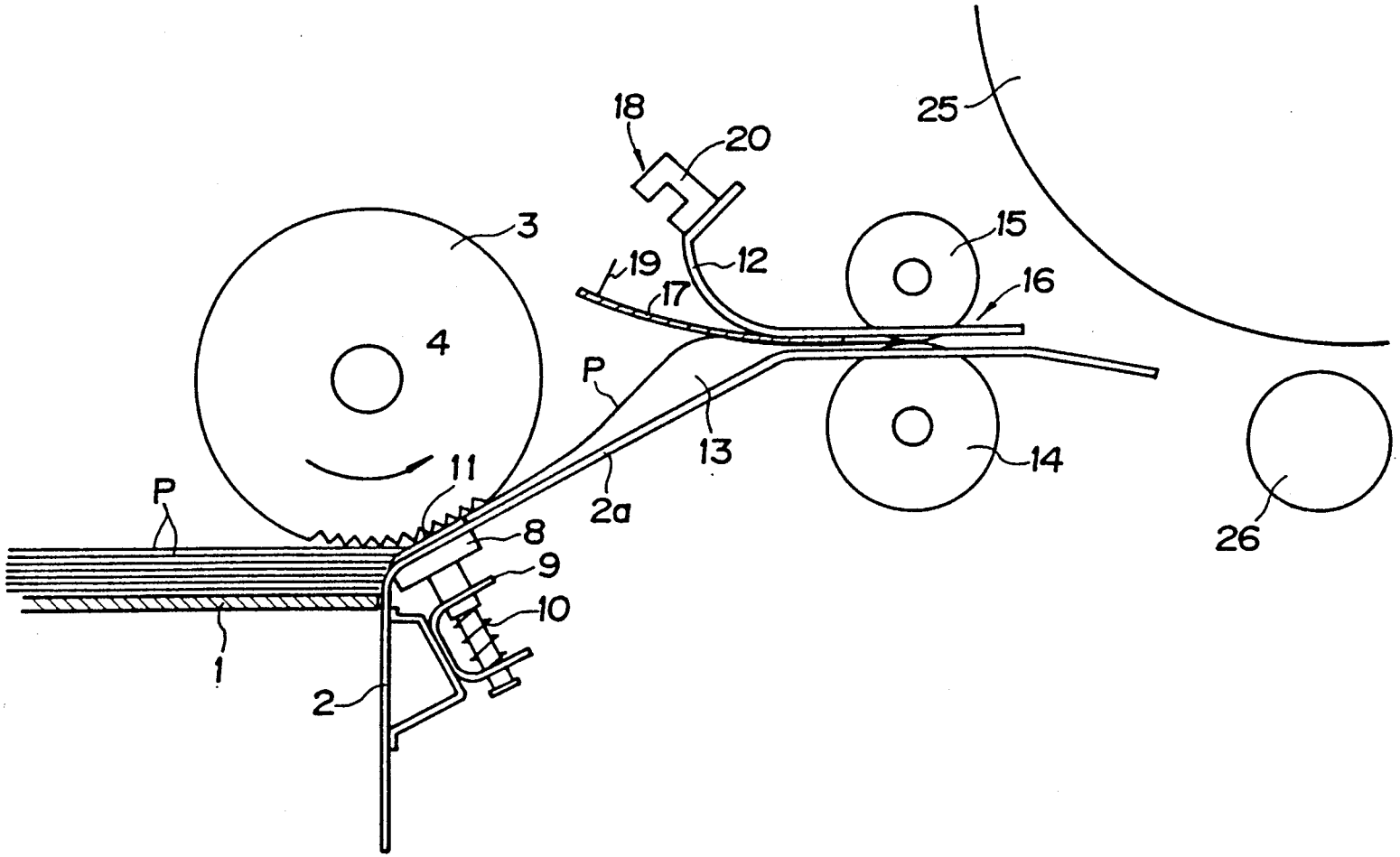
FIGS. 3 and 4 are schematic side views similar to FIG. 1 showing the operation of the first embodiment of the sheet feeding device shown in FIGS. 1 and 2.
Figure 4:
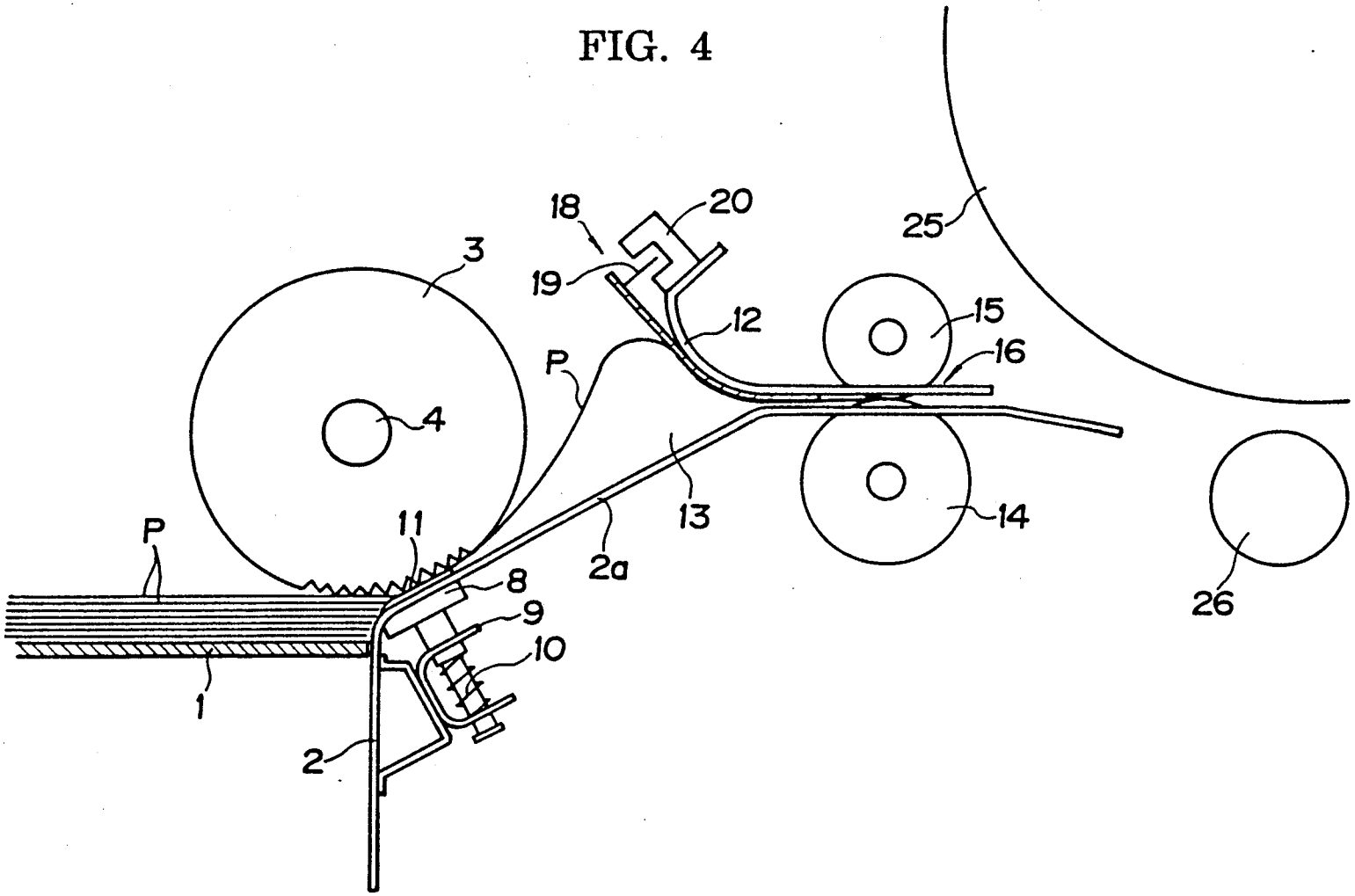

As shown in FIGS. 1, 3 and 4, the fixed upper guide plate 12 includes an upstream and a downstream segments. The upstream segment is bent upward between the sheet feeding roller 3 and the register roller means 16 so that the sheet being fed can generate a curvature substantially across the sheet feeding direction as shown in FIG. 4. The downstream segment extends substantially in the horizontal direction. Similarly the fixed lower guide plate 2*a* includes an upstream and a downstream segments. The upstream segment is inclined up as viewed in the downstream direction and the downstream segment extends substantially in the horizontal direction.

The movable sheet guide plate 17 which is made of any flexible material such as a plastic film or the like is positioned between the lower guide plate 2*a* and the upper guide plate 12 and extends substantially along of the sheet feeding passage 13. The movable guide plate 17 is secured to the under surface of the upper guide plate 12 at its end 17*a* adjacent the register roller means 16 and defines a free end at the opposite end 17*b* near the roller 3. Thus the sheet guide plate 17 can deform elastically in the upward and downward directions as viewed in FIG. 1 to bend arcuately as shown in FIGS. 3 and 4 following the curving deformation of sheet and maintains in its free state the generally planner shape to define in combination with the lower guide plate 2*a* the sheet feeding passage 13 having substantially a wedge shape.

A tongue-like movable element 19 of a curvature detector 18 is fixed to the free end 17*b* of the sheet guide plate 17. The curvature detector 18 is comprised of the above mentioned movable element 19 and a photoelectric sensor 20 secured to the upper end of the upper guide plate 12. Although not shown in detail in the figures, the sensor includes a light transmitter and a light receiver and defines a light passage therebetween which is selectively intercepted by the movable element. Thus the detector is able to determine that a predetermined extent of curvature has been reached by the deformation of a sheet when the movable guide plate 17 has made an arcuate elastic deformation to a predetermined extent, i.e., in this embodiment, when the movable guide plate 17 has elastically deformed substantially to abut with the bent part of the upper guide plate 12 as shown in FIG. 4 and the movable element 19 has arrived at the position where it intervenes in the light passage of the photoelectric sensor 20. The sensor 20 varies its output voltage when the movable element 19 has reached at the intervening position and supplies an output signal to the electric controller, which in turn sends its command signal to the electromagnetic clutch for disengaging it.

In operation, when the electromagnetic clutch 6 is engaged, the sheet feeding roller 3 is rotationally driven in the anti-clockwise direction as viewed in FIG. 1. The upper most one of the sheets P stacked on the sheet feeding base 1 is fed by the roller 3 in the sheet feeding direction to enter between the roller 3 and the sheet separating pad 11, and is transported toward the contact parts between the roller elements 14 and 15 of the register roller means 16 with the guide served by the both the lower guide plate 2*a* and the sheet guide plate 17. Since at this stage of the process the movable guide plate 17 maintains the generally planner shape and defines a substantially straight wedge-like sheet feeding passage 13 in corporation with the lower guide plate 2*a*, even though the sheet P to be fed is curled up at the front end thereof, it may not collide with any surface of the plates defining the sheet feeding passage 13 and may not hindered from moving forward.

It should be noted that since the frictional resistance between the sheet and the sheet separating pad 11 is larger than that between the sheets, if a plurality of sheets enter in piles between the sheet feeding roller 3 and the separating pad 11, only one sheet which is nearest to the roller 3, i.e., the uppermost sheet is fed forward toward the register roller means.

When the front extremity of the sheet P arrives at the contact parts between the roller elements 14 and 15 of the register roller means 16, the extremity is precluded from progressing further by the roller elements which have not yet been rotated and retain their stationary state, while on the other hand the sheet feeding roller 3 continues to rotate at least for a little while in the anti-clockwise direction as viewed in FIG. 1. Accordingly the sheet P being fed generates a ridge-like curvature between the register roller means 16 and the feeding roller 3. As the sheet P increases its arcuate deformation, as is shown in FIG. 3, the sheet guide plate 17 elastically deforms upward in the figure by the pushing action of the sheet P, thereby allowing it to bend arcuately. When the curvature of the sheet P has reached a predetermined extent, the sheet guide plate 17 elastically deforms to its full extent where it substantially abuts with the curved part of the upper guide plate 12 as shown in FIG. 4 and does not deform any more. At this stage of the process the movable element 19 intervenes in the light passage of the photoelectric sensor 20, and the sensor determines that the curvature of the sheet has reached a predetermined extent, and the electromagnetic clutch 6 is disengaged to cease the rotation of the feeding roller 3 in the anti-clockwise direction as viewed in FIG. 1.

Thus when the curvature of the sheet P between the feeding roller 3 and the register roller means 16 has reached a predetermined extent, the roller 3 is stopped to prevent the curvature of the sheet from increasing excessively and to prevent the front extremity of the sheet P from pulling out from the contact parts between the roller elements 14 and 15 of the register roller means 16.

As will be realized from the function of the sheet guide plate 17, it must have both a sufficient flexibility to ensure the elastic deformability permitting itself to bend according to the arcuate deformation of the sheet which is supplest among the sheets intended to be used and a sufficient rigidity to retain its planer shape in the free state.

Figure 5:
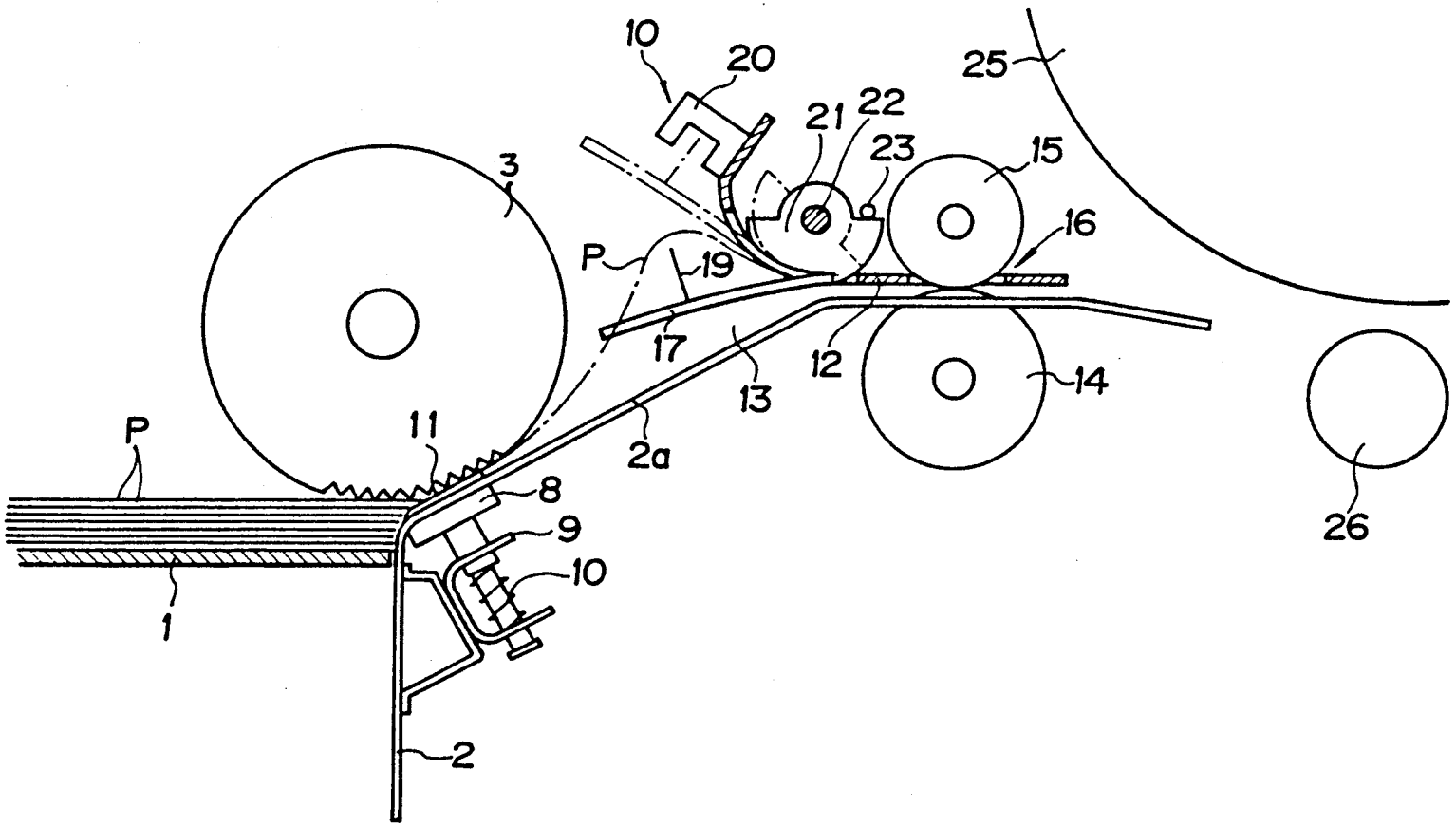
FIGS. 5 through 7 are schematic views showing in vertical section the second, the third, and the fourth embodiments of the sheet feeding device of the present invention, respectively.
Figure 6:
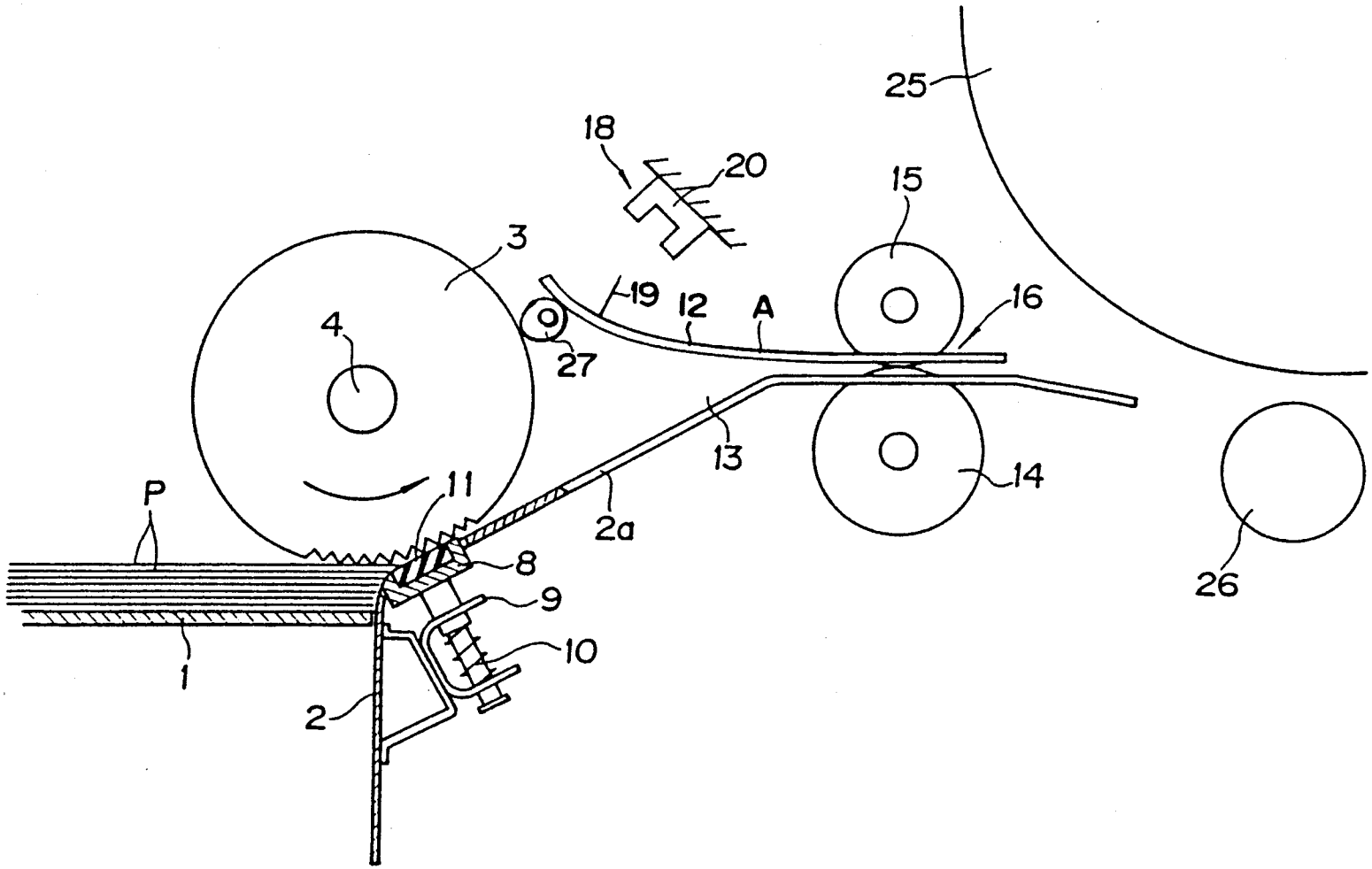
Figure 7:
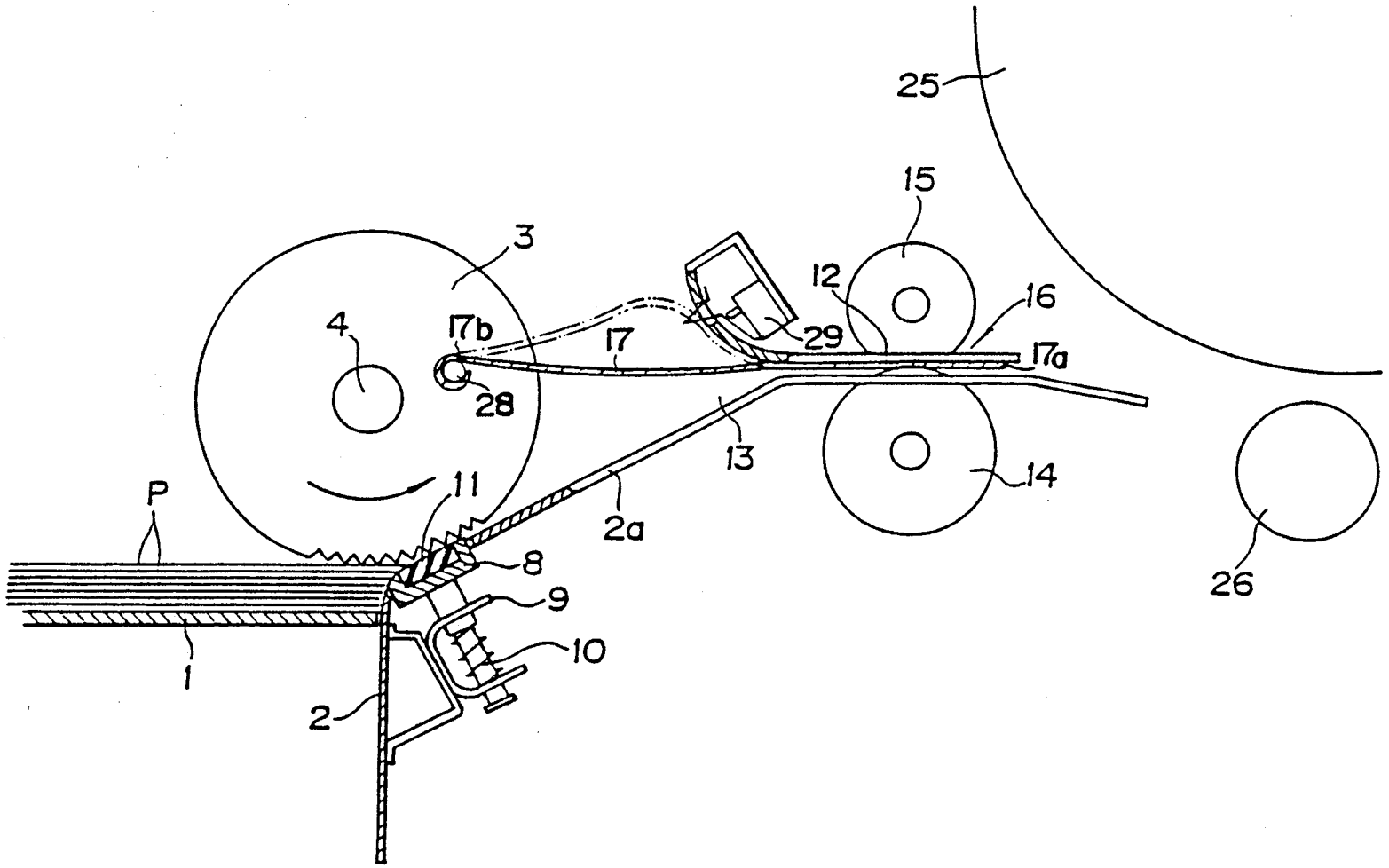

FIGS. 5 through 7 show other embodiments of the sheet feeding device according to the present invention. It should be noted that in FIGS. 5–7 portions or parts corresponding to those shown in FIG. 1 are given the same reference numerals as in FIG. 1.

In the second embodiment shown in FIG. 5, the sheet guide plate 17 is made of a rigid material such as a metal plate or the like and its downstream end adJacent the register roller means 16 is secured to a holder 21, which is in turn rotatably supported by way of a pivot shaft 22 from a machine frame not shown so that the plate 17 may pivot up and down, i.e., substantially along the curvature growing direction of a sheet. The upper guide plate 12 has a hole provided at the bent part thereof so that it may not interfere with the rotation of the holder 21 and the pivotal movement of the guide plate 17. A stopper pin 23 is fixedly provided adjacent to the shaft 22 and selectively engages with a shoulder formed on the holder 21. The sheet guide plate 17 biases itself with its own weight so as to pivot toward the lower guide plate 2*a* and is positioned by the stopper pin 23 in its free state so that it may extend substantially along the lower guide plate 2*a* as shown in the figure to define in combination with the lower guide plate 2*a* the sheet feeding passage 13 having a relatively narrow wedge-like space therebetween.

In this embodiment, the curving deformation of a sheet P formed between the sheet feeding roller 3 and the register roller means 16 causes the sheet guide plate 17 to pivot on the shaft 22 in the clockwise direction as viewed in the figure as if the plate were pushed up. Thus in this embodiment, substantially the same operation and benefits can be attained as in the first embodiment shown in FIGS. 1 through 4.

As is appreciated, the force required to pivot the sheet guide plate 17 may be established for example by its own weight so that it may be pivoted upward as viewed in the figure by the curving deformation of the sheet which is most flexible among the sheet intended to be used.

As will be apparent to those skilled in the art from the figure, since the movable element 19 of the curvature detector 18 is attached to the sheet guide plate 17, the stopping control for the sheet feeding roller 3 is effected in the same manner as in the above mentioned embodiment.

In this embodiment, as the stopper pin 23 determines the free state position, i.e., the initial pivotal position of the sheet guide plate 17, the position of the pin 23 may be changed either manually or by any suitable actuator, not shown, such as an electric motor, a solenoid and the like, which enables to set the initial pivotal position of the sheet guide plate 17 to a desirable position according to, for example, the type of sheet.

In the third embodiment shown in FIG. 6, the upper guide plate 12 itself is adapted to serve as a movable sheet guide plate. To achieve this, the upper guide plate 12 may be made of a metal plate with a suitable flexibility or may include an integral hinge arrangement such as a traversingly extending thinned part or the like at the location denoted with A in FIG. 6 so as to bend elastically. As is schematically shown in the figure, the photoelectric sensor 20 of the curvature detector 18 may be secured to a fixed member such as a machine frame or the like.

In this embodiment, an off-center cam 27 is provided which engages with the under surface of the upstream end of the upper guide plate 12 and enables to adjust the initial position of the upstream half of the upper guide plate 12.

As will be realized by those skilled in the art, in this embodiment substantially the same operation and benefits can be attained as in the first and the second embodiments shown in FIGS. 1 through 5, except that the upper guide plate 12 achieves the functions of both the fixed upper guide plate 12 and the sheet guide plate 17 in the embodiments.

In the fourth embodiment shown in FIG. 7, the sheet guide plate 17 is made of a flexible thin sheet material including a plastic film. The upstream end 17*b* of the guide plate 17 is located radially inward of the peripheral of the roller 3 on both sides thereof and is cut off in rectangular shape at the part corresponding to the roller 3 so as to clear it off. The guide plate 17 is fixedly supported at its upstream end 17*b* near the sheet feeding roller 3 by a pair of support shafts 28 which are positioned on both sides of the roller and are attached to a machine frame, and defines a free end at the downstream end 17*a* near the register roller means 16. Approximately the downstream half of the guide plate 17 is biased by its own elasticity against the under surface of the upper guide plate 12 to abut with and slide relative to the plate 12.

Thus in this embodiment, the sheet guide plate 17 cooperates with the lower guide plate 2*a* and the sheet feeding roller 3 to define the sheet feeding passage 13 which is substantially confined and enables a more positive transportation of sheets from the sheet feeding base 1 toward the register roller means 16.

The sheet guide plate 17 bends itself like a ridge as shown in phantom line in the figure in response to the curvature of the sheet P and the end 17*a* moves in the upstream direction along the under surface of the upper guide plate 12. From the above, it will be noted that the sheet guide plate 17 must have a sufficient length to prevent the dislodging of the end 17*a* from the upper guide plate 12 when the guide plate 17 elastically deform as described above.

In this embodiment, the curvature detector is comprised of a microswitch 29 which is fixedly attached to the upper end of the bent part of the guide plate 12 and is adapted to be operated by the sheet guide plate 17.

It should be understood that a contact type microswitch may be used as a curvature detector in the first through third embodiments in place of the photoelectric sensor.

It is also to be noted that the movable sheet guide member is not limited to a plate or a sheet, it may take any suitable form such as, for example, a plurality of wire elements or a mesh member extending between the sheet feeding roller and the register roller means.

Although the present invention has been shown and described in detail in terms of several embodiments thereof, the present invention is not restricted to these embodiments, and it will be seen by those skilled in the relevant art that the various modifications are possible within the scope of the present invention.

What is claimed is:

1. A sheet feeding device for an image developing and processing machine comprising a sheet feeding base on which a plurality of sheets are stacked, a selectively driven sheet feeding roller for taking up and feeding a plurality of sheets one by one from said stack, and a register roller means for transporting the sheet to an image developing and processing device at a predetermined timing, fixed upper and lower guide plates, a movable sheet guide member provided between said sheet feeding roller and said register roller means which is adapted to be displaced by the curving deformation of a sheet between said sheet feeding roller and said register roller means in the direction of the growing of said curving deformation, said movable sheet guide member being positioned between said upper and lower plates, wherein the upstream end of said upper guide plate is bent away from said lower guide plate and wherein at least the leading end of said movable sheet guide member is adapted to be elastically bent away from said lower guide plate.

2. The sheet feeding device for an image developing and programming machine according to claim 1 further comprising a detecting means a detecting means for sensing the displacement of said sheet guide member to determine based upon the displacement that a predetermined curvature of the sheet has been reached, and a stopper means for stopping the rotation of said sheet feeding roller in response to the detection by said detecting means.

* * * * *